US011976485B2

(12) United States Patent
Hendren

(10) Patent No.: US 11,976,485 B2
(45) Date of Patent: May 7, 2024

(54) SYSTEM FOR SELF-SUSTAINING MODULAR HOUSING

(71) Applicant: Gary W. Hendren, Chestnut Hill, MA (US)

(72) Inventor: Gary W. Hendren, Chestnut Hill, MA (US)

( * ) Notice: Subject to any disclaimer, the term of this patent is extended or adjusted under 35 U.S.C. 154(b) by 34 days.

(21) Appl. No.: 17/731,413

(22) Filed: Apr. 28, 2022

(65) Prior Publication Data

US 2022/0349194 A1 Nov. 3, 2022

Related U.S. Application Data

(60) Provisional application No. 63/183,587, filed on May 3, 2021.

(51) Int. Cl.

| | |
|---|---|
| ***E04H 1/00*** | (2006.01) |
| ***E04B 1/343*** | (2006.01) |
| ***E04H 1/12*** | (2006.01) |

(52) U.S. Cl.

CPC ..... *E04H 1/005* (2013.01); *E04B 1/34321* (2013.01); *E04H 1/1205* (2013.01)

(58) Field of Classification Search

CPC ..... E04H 1/005; E04H 1/02; E04H 1/1205; E04B 1/34321

See application file for complete search history.

(56) References Cited

U.S. PATENT DOCUMENTS

| | | | | |
|---|---|---|---|---|
| 5,083,410 | A * | 1/1992 | Watson | E04B 2/72 52/481.1 |
| 8,776,449 | B1 * | 7/2014 | Rowan | E04H 1/1205 52/79.1 |
| 2007/0175108 | A1 * | 8/2007 | Stein | E04B 1/34321 52/79.5 |
| 2009/0223143 | A1 * | 9/2009 | Esposito | E04H 1/1205 52/745.19 |
| 2015/0345126 | A1 * | 12/2015 | Ryan | E04B 5/02 52/11 |
| 2016/0010324 | A1 * | 1/2016 | Thrall | E04B 1/34357 52/745.02 |
| 2017/0025988 | A1 * | 1/2017 | Blaskovich | C02F 1/283 |
| 2017/0260737 | A1 * | 9/2017 | Ota | E04H 1/02 |
| 2017/0306610 | A1 * | 10/2017 | Leahy | E04C 2/526 |
| 2019/0085575 | A1 * | 3/2019 | Opoku | E04B 1/343 |
| 2021/0270030 | A1 * | 9/2021 | Krasnoff | E04C 2/26 |
| 2022/0349195 | A1 * | 11/2022 | Rogers | E04B 1/34321 |

* cited by examiner

*Primary Examiner* — Gisele D Ford

(74) *Attorney, Agent, or Firm* — Matthew M. Yospin

(57) ABSTRACT

Systems are provided for self-sustaining modular housing. The system presented comprises construction materials which are readily manufactured, flat-packed, stored, shipped, and assembled on-site without skilled labor, to construct the system. The system further presents sustainable features for increasing the health and safety of life when people require modular housing, by presenting modular housing to fit a variety of needs, sizes, arrangements, and levels of durability and strength of construction. The present invention solves problems with the currently available systems of modular housing and housing for temporary disaster relief and other temporary uses.

5 Claims, 9 Drawing Sheets

SYSTEM FOR SELF-SUSTAINING MODULAR HOUSING

FIELD OF THE INVENTION

The presently disclosed subject matter relates to providing housing, and more particularly, to a system for flat-pack and modular self-sustaining housing units assembled from panels that may be easily shipped and assembled on-site.

BACKGROUND OF THE INVENTION

In emergency housing, for disaster-relief and other purposes, tents or trailers are commonly used. While tents are relatively easy to store and ship, they have several shortcomings as housing: they are insecure, difficult to heat or cool, and are susceptible to severe weather, including wind, rain, hail, and snow. Trailers, storage containers with retrofits, and other modular housing units are used as emergency housing, and these also have several shortcomings: they are difficult and expensive to ship as they are bulky, they are expensive to store for the same reasons, and it is hard to scale up production when a large supply is needed to meet particular emergency-housing needs. Having new materials for repair of damaged housing or construction of new housing is often unfeasible, in a region struck by a disaster or in other need of emergency housing, because supplies are often damaged by the cause of the emergency or inaccessible due to the emergency. Additionally, because repair and/or new construction of housing are labor-intensive, it is often hard to find a sufficient supply of people with the skills to repair or build new housing in a region struck by a disaster or in need of emergency housing for any reason. All of the foregoing needs are present for housing in general.

There is a need for modular housing that is secure and can be secured, so that people using it, who are often suffering from the trauma or disaster that created the need for modular housing, can be secure in their persons and their temporary home. There is a need for modular housing that can be heated and cooled effectively and affordably. There is a need for modular housing that is weather-resistant: hurricane-resistant, wind-resistant, fire-resistant, and resistant to rain, snow, hail, and other precipitation. There is a need for modular housing that is shippable easily and affordably. There is a need for modular housing that can be manufactured in advance of the need for it, and stored affordably and compactly. There is a need for modular housing that is scalable, and can be made from readily available and shippable building materials, or materials that can be manufactured for use in constructing modular housing, and are affordable. There is a need for modular housing that uses modular components for plumbing and appliances. There is a need for modular housing that provides sustainable and energy-efficient modular housing. And there is a need for modular housing that can be assembled on-site by people without specialized skills in construction, and without use of a crane or without use of a large crane or other heavy construction equipment.

The prior art does not meet the needs of society to make, store, ship, or assemble such modular housing.

SUMMARY OF THE INVENTION

The present invention meets all these needs, by disclosing a system for modular self-sustaining housing that may be made of common construction materials, advantageously glassfiber reinforced concrete panels (GFRC), that is, panels comprising concrete that is reinforced with glass fibers, flat-packed, shipped, and assembled on-site.

The present invention addresses the problems of the prior art, which do not present systems for readily flat-packable modular housing, modular housing that is affordable to store and to ship, and readily assembled from panels. The present disclosure addresses the problems of the prior art by presenting modular housing that may be assembled on-site without skilled labor, and which is secure and safe housing. The present disclosure addresses the problems of the prior art by presenting self-sustaining modular housing that may be used to harvest and store rainwater and other precipitation, and can be heated and cooled effectively and cost-effectively, while being resistant to rough weather, along with other sustainable aspects of the modular housing of the present disclosure. The present disclosure addresses the problems of the prior art by presenting modular housing that is shippable easily and affordably. The present disclosure addresses the problems of the prior art by presenting modular housing that can be manufactured in advance of the need for it, and stored affordably and compactly. The present disclosure addresses the problems of the prior art by presenting modular housing that is scalable, and can be made from readily available and shippable building materials, or materials that can be manufactured for use in constructing modular housing, and are affordable. The present disclosure addresses the problems of the prior art by presenting modular housing that uses modular components for plumbing and appliances. The present disclosure addresses the problems of the prior art by presenting modular housing that can be assembled on-site by people without specialized skills in construction, and without use of a crane or without use of a large crane or other heavy construction equipment.

In one aspect, the present disclosure teaches a system for modular self-sustaining housing. In one aspect, the present disclosure teaches a system for self-sustaining modular housing.

These aspects of the present invention, and others disclosed in the Detailed Description of the Drawings, represent improvements on the current art. This summary is provided to introduce a selection of concepts in a simplified form that are further described below in the Detailed Description of the Drawings. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of various aspects, is better understood when read in conjunction with the appended drawings. For the purposes of illustration, the drawings show exemplary aspects; but the presently disclosed subject matter is not limited to the specific methods and instrumentalities disclosed. In the drawings, like reference characters generally refer to the same components or steps of the device throughout the different figures. In the following detailed description, various aspects of the present invention are described with reference to the following drawings, in which.

DETAILED DESCRIPTION OF THE DRAWINGS

Figure 1:
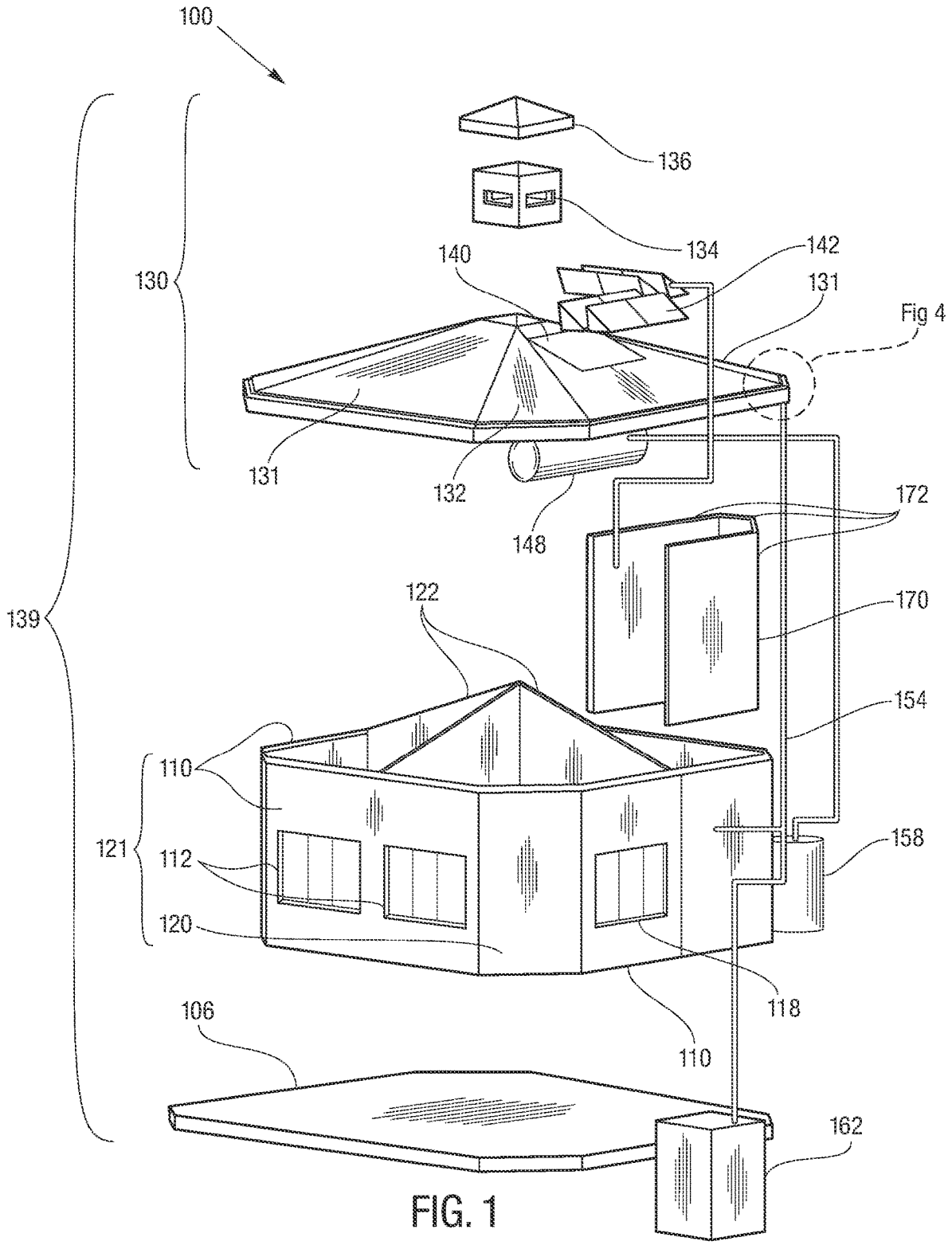
FIG. 1 shows an exploded perspective view of an aspect of the system of the present invention.
Figure 2:
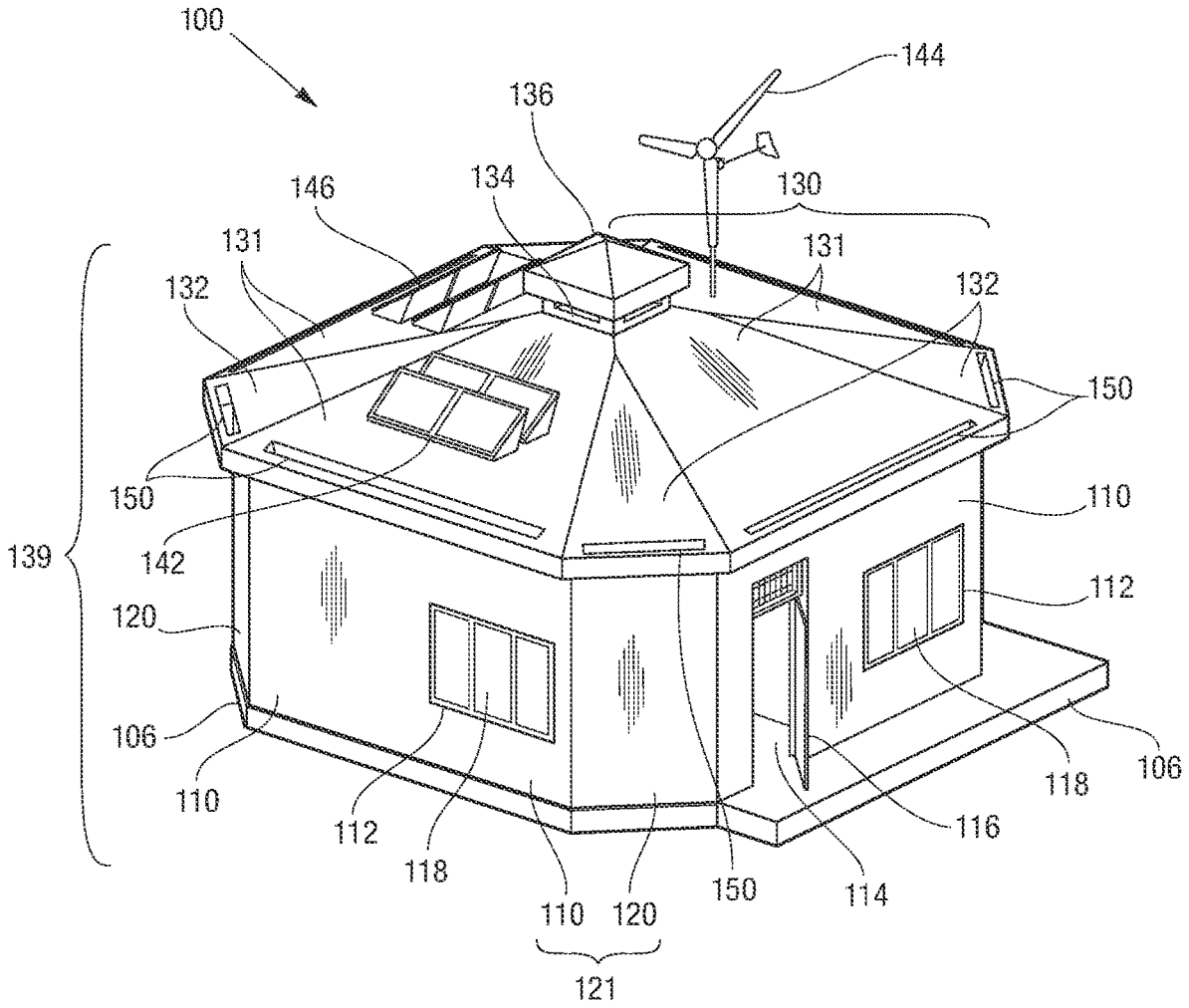
FIG. 2 shows a perspective view of an aspect of the system of the present invention.
Figure 3:
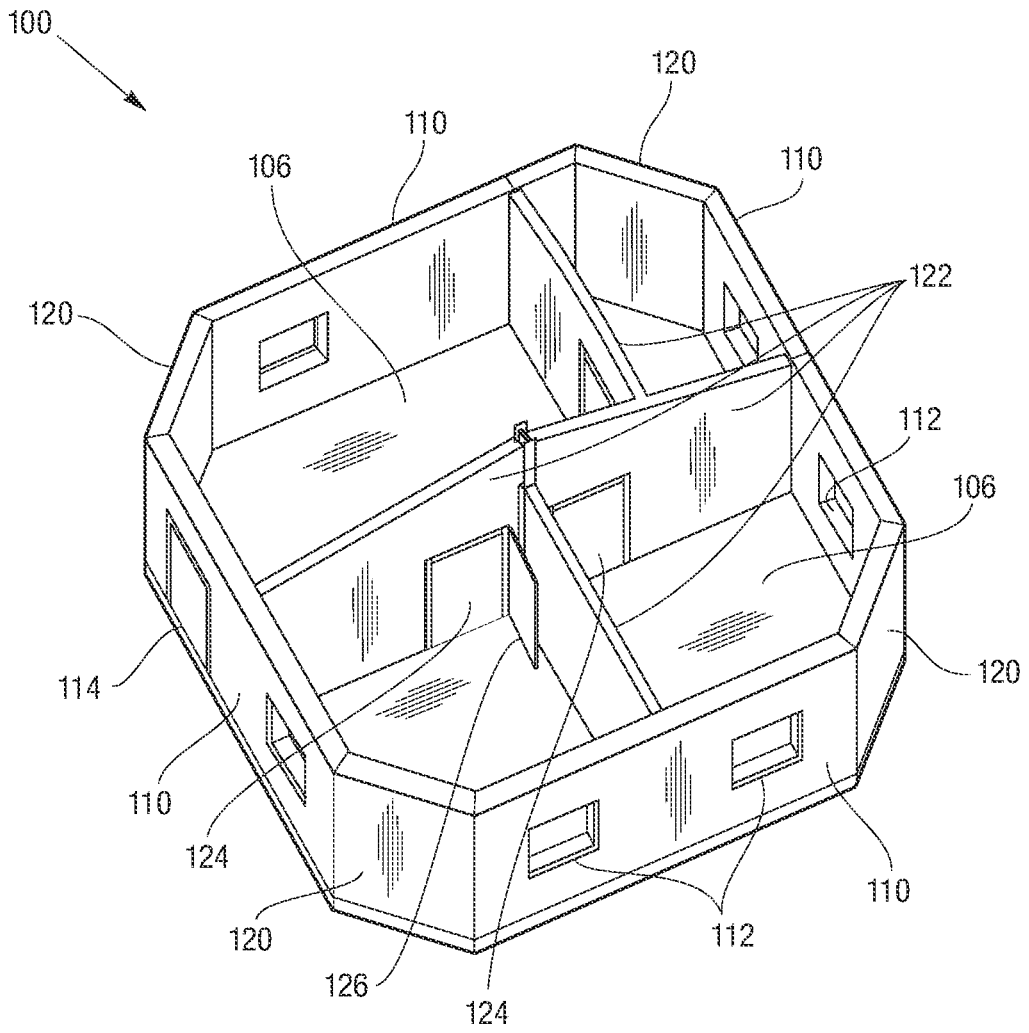
FIG. 3 shows a perspective view of an aspect of the system of the present invention.
Figure 4:
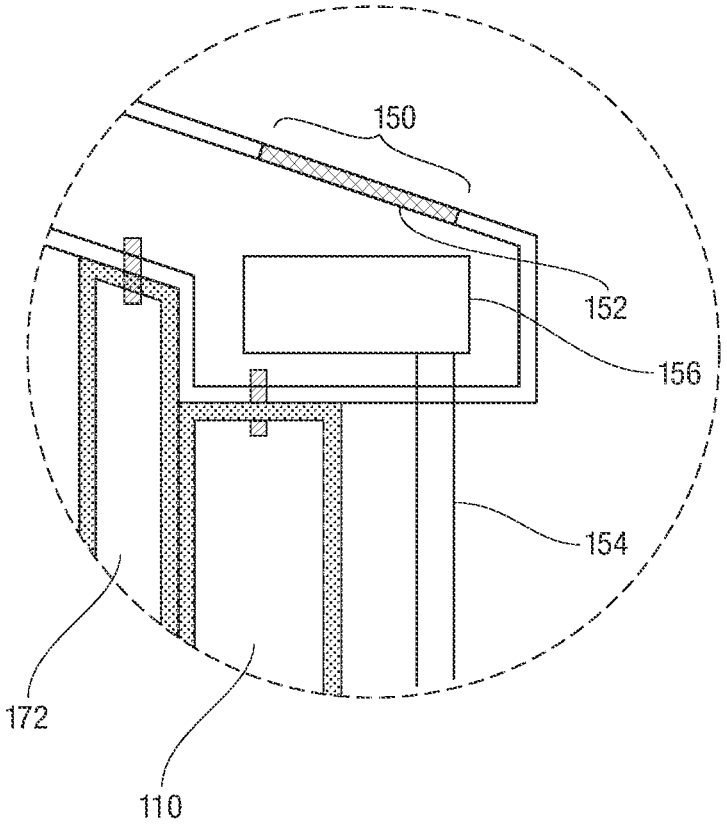
FIG. 4 shows a cross-sectional elevation view of an aspect of the system of the present invention.
Figure 5:
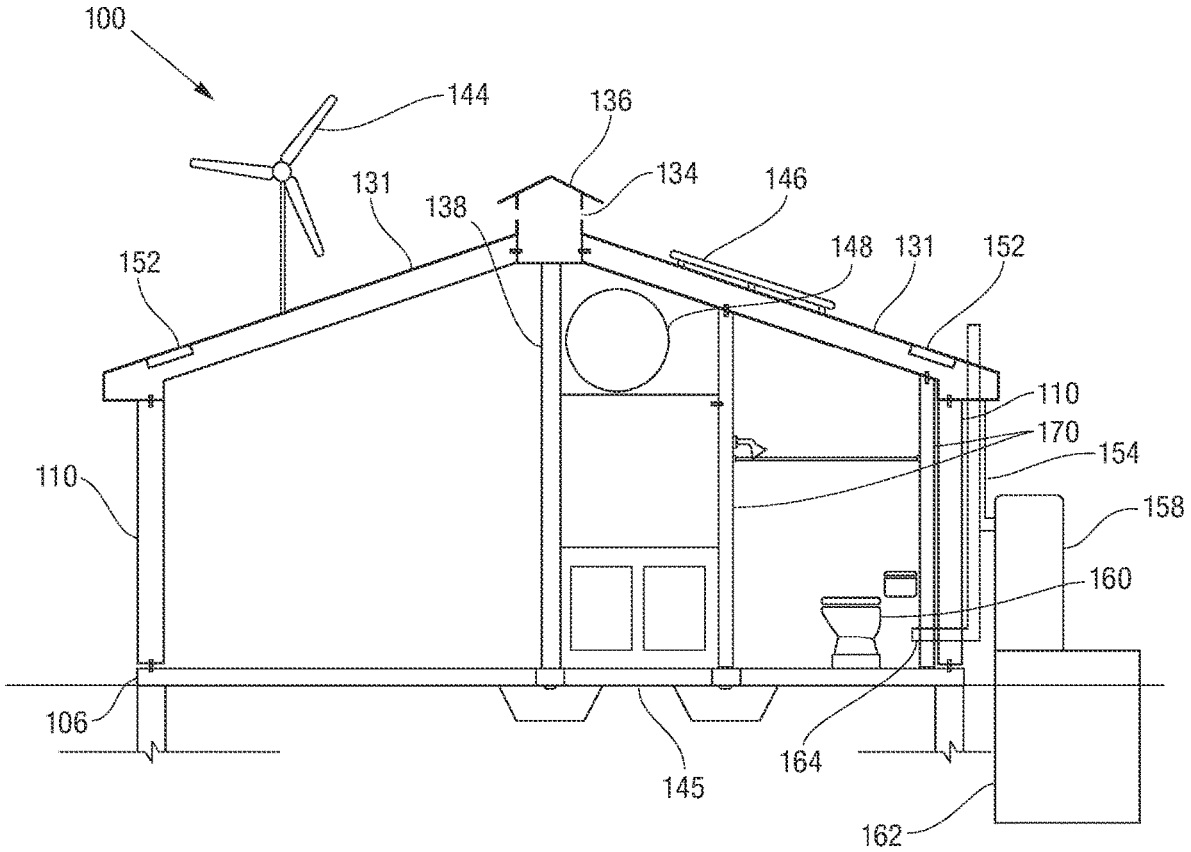
FIG. 5 shows a cross-sectional elevation view of an aspect of the system of the present invention.
Figure 6:
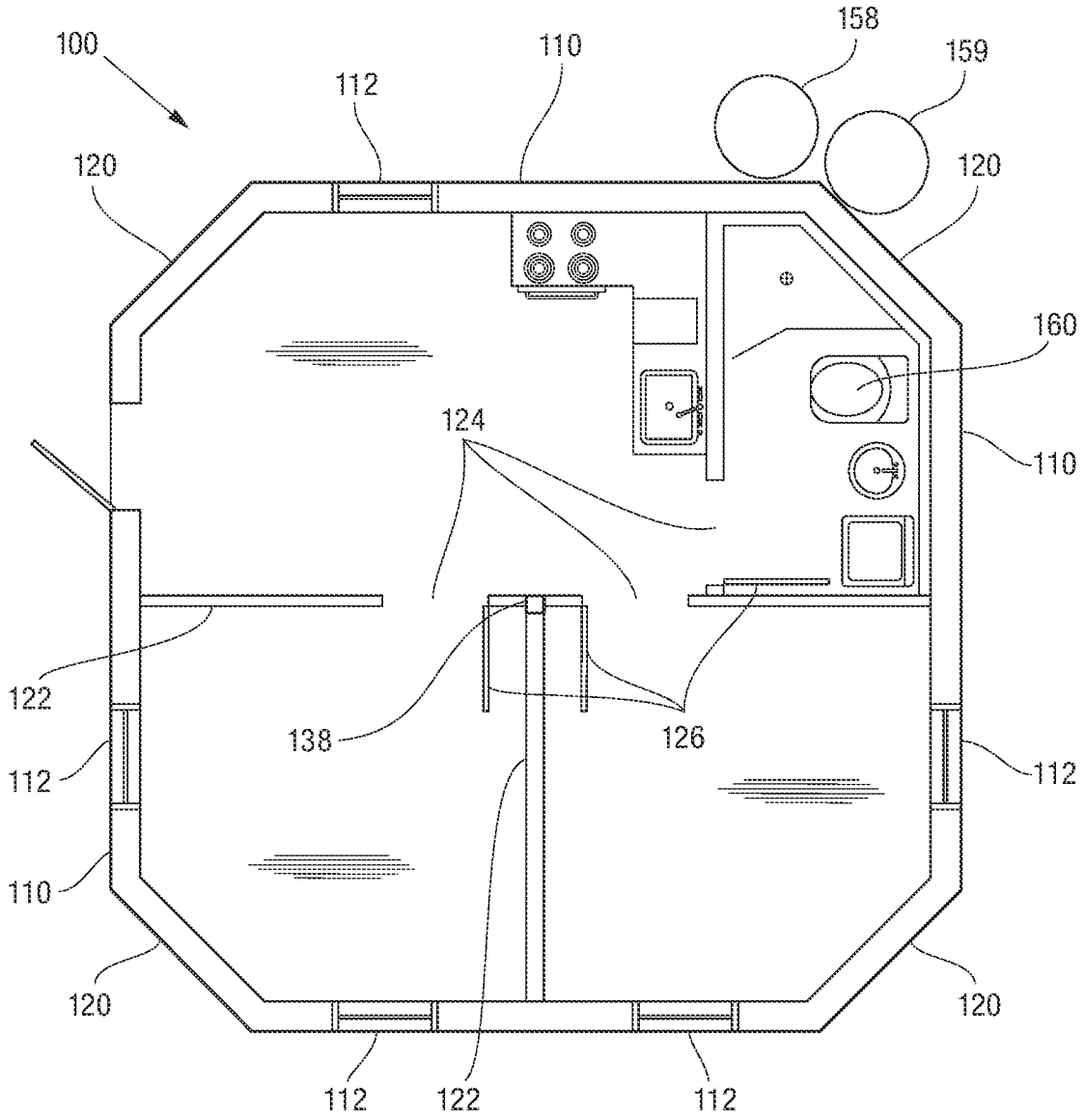
FIG. 6 shows a top plan cross-sectional view of a configuration of the system of the present invention.
Figure 7:
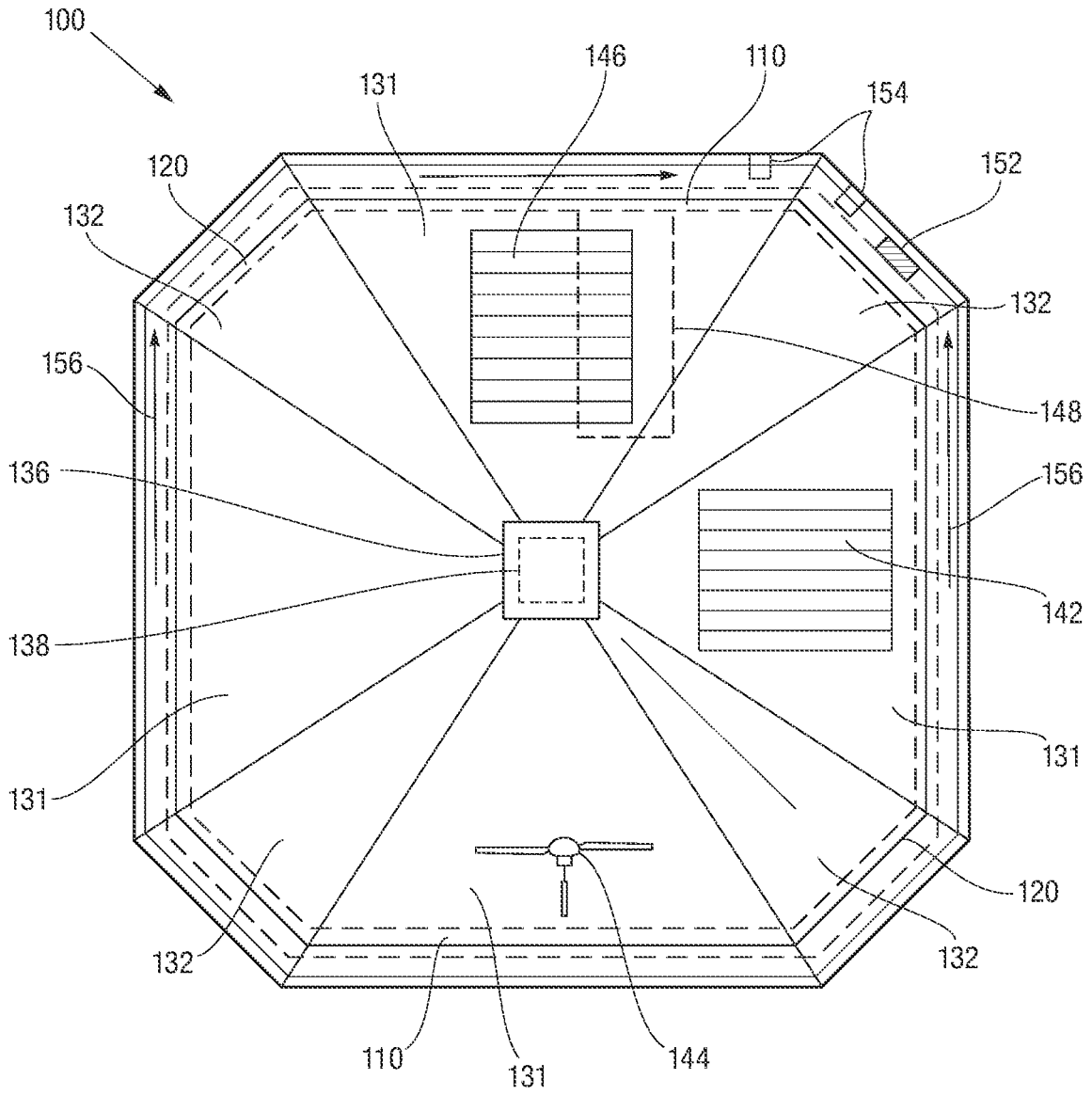
FIG. 7 shows a top plan view of a configuration of the system of the present invention.

The presently disclosed invention is described with specificity to meet statutory requirements. But, the description itself is not intended to limit the scope of this patent. Rather, the claimed invention might also be configured in other ways, to include different steps or elements similar to the ones described in this document, in conjunction with other present or future technologies. Moreover, although the term "step" or similar terms may be used herein to connote different aspects of methods employed, the term should not be interpreted as implying any particular order among or between various steps herein disclosed unless and except when the order of individual steps is explicitly described. The word "approximately" as used herein means within 10% of a stated value, and for ranges as given, applies to both the start and end of the range of values given.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the system and methods of use the present invention.

The present invention comprises a system 100 for self-sustaining modular housing, referred to herein as a self-sustaining modular housing system. The system 100 may advantageously comprise glass fiber reinforced concrete panels (GFRC) pre-fabricated panels that can be shipped to a disaster site, or to any place or region, as flat panels and modular components, and then easily assembled using basic tools by a small crew of people. The system 100 comprising panels, such panels described in more detail and variety herein, made of GFRC, in the range of geometric shapes described in the present disclosure, will withstand high winds, is resistant to rain, hail, snow, ice, and other precipitation, and is fire-proof. The interior components of the system 100 for a bathroom and a kitchen are modules or modular components that can be assembled and/or installed after a structure of the system 100 is complete. The system 100 may have: solar-power and/or wind-power units for generating electricity; a plurality of batteries for storing electricity; heating and/or cooling; a solar-assisted composting toilet; components for collection and storage of rainwater or other precipitation; and/or components for refrigeration and cooking.

With reference to FIG. 1, FIG. 2, FIG. 3, FIG. 4, FIG. 5, FIG. 6, FIG. 7, FIG. 8, and FIG. 9, the system 100 may comprise a plurality of exterior wall panels 110, a plurality of exterior corner panels 120, a plurality of window openings 112, a plurality of exterior door openings 114, a plurality of exterior doors 116, and/or a plurality of windows 118. The exterior wall panels 110, the window openings 112, the windows 118, the exterior door openings 114, and the exterior doors 116 together comprise a plurality of exterior walls 121. The system 100 may further comprise a plurality of exterior corner panels 120, and where the system 100 comprises exterior corner panels 120, the exterior walls 121 further comprise the exterior corner panels 120.

With reference to FIG. 1, FIG. 2, FIG. 3, FIG. 5, FIG. 6, FIG. 7, FIG. 8, and FIG. 9, the system 100 may comprise a plurality of a plurality of flooring panels 106, a plurality of interior wall panels 122, a plurality of interior door openings 124, and/or a plurality of interior doors 126. The system 100 further comprises a roof 130, the roof 130 comprising a plurality of principal roof panels 131, a plurality of corner roof panels 132, a roof vent support 134, and/or a roof vent cap 136. The roof 130 and the exterior walls 121, together with any flooring panels 106, comprise an exterior structure 139. The system 100 may further comprise a post 138 for support of the roof 130. In some aspects of the present disclosure, the system 100 may be implemented without flooring panels 106, such that the exterior structure 139 comprises the exterior walls 121 and the roof 130; in that or any aspect of the system 100, the exterior structure 139 may be placed on a concrete slab or other suitable footing, as will be apparent to one of skill in the art, where the flooring panels 106 are not used in the system 100.

Any or all of the flooring panels 106, the exterior wall panels 110, the exterior doors 116, the exterior corner panels 120, the interior wall panels 122, the interior doors 126, the principal roof panels 131, the corner roof panels 132, the roof vent support 134, the roof vent cap 136, and/or the post 138 may comprise one or more GFRC panels, in whole or in part for any component comprising one of the foregoing elements or a different element of the system 100. Any of the foregoing components may comprise GFRC in whole, in significant part, or in some part. In any aspect of the system 100, any number of each of the foregoing components may comprise GFRC in whole, in significant part, or in some part.

With reference to FIG. 1, FIG. 2, FIG. 3, FIG. 5, FIG. 6, and FIG. 7, the system 100 may, in some aspects, comprise a number of the foregoing relevant components to form a system 100 comprising two bedrooms, as depicted. Namely and without limitation, a quantity of each of the exterior wall panels 110, the window openings 112, the exterior door openings 114, the exterior doors 116, the windows 118, the exterior corner panels 120, the exterior walls 121, the interior wall panels 122, the principal roof panels 131, the corner roof panels 132, and the flooring panels 106 if comprised in the system 100, may all be varied to a number that is desirable. Such an aspect of the system 100 may comprise two bedrooms, a cooking and dining and living room area, and a bathroom area. It will be apparent to one of skill in the art that a similarly sized and shaped aspect of the system 100 may be configured with more rooms or fewer rooms and/or rooms for different uses by inhabitants, by varying the size and arrangement of the interior wall panels 122 to form a plurality of rooms of desired shapes, either by the people assembling the system 100 or by the people manufacturing the system 100.

Figure 8:
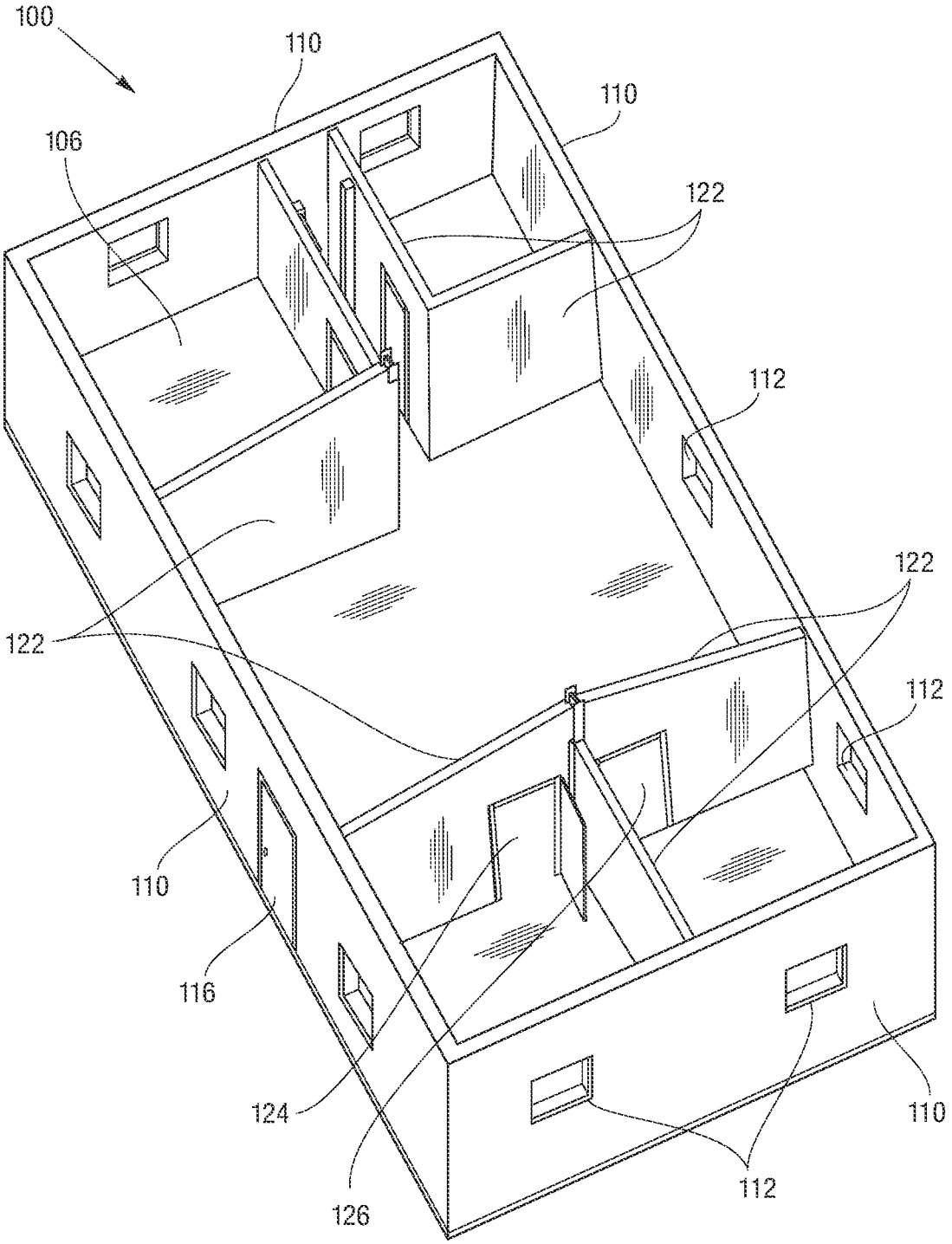
FIG. 8 shows a perspective view of an aspect of the system of the present invention.
Figure 9:
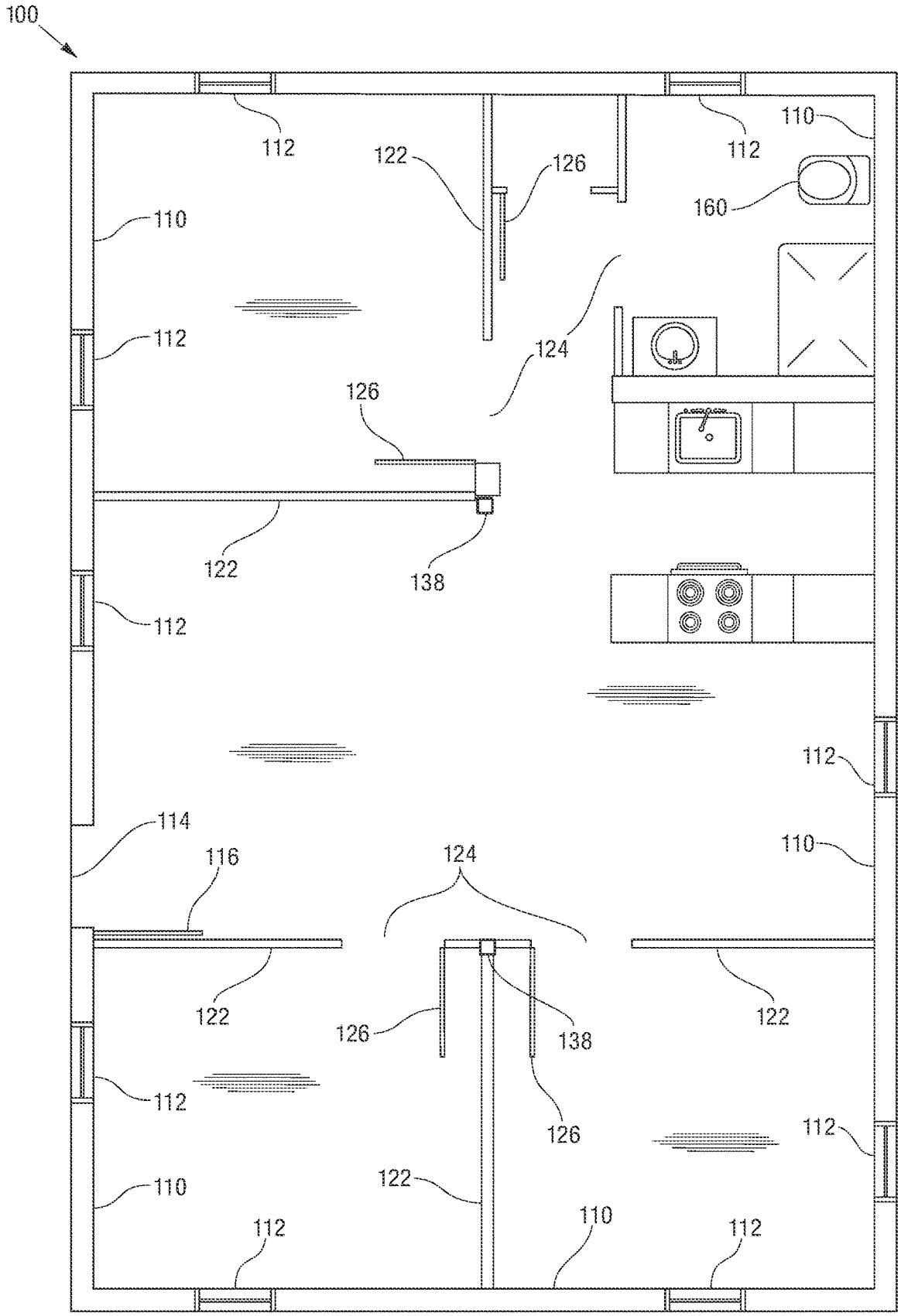
FIG. 9 shows a top plan cross-sectional view of a configuration of the system of the present invention.

With reference to FIG. 8 and FIG. 9, the system 100 may, in some aspects, comprise a number of the foregoing relevant components to form a system 100 comprising three bedrooms, as depicted, or a system 100 comprising four bedrooms, as depicted, or a system 100 with any other number of rooms and variety of rooms, as may be desired in different aspects of the present disclosure. Namely and without limitation, a quantity of each of the exterior wall panels 110, the window openings 112, the exterior door openings 114, the exterior doors 116, the windows 118, the exterior corner panels 120, the exterior walls 121, the interior wall panels 122, the principal roof panels 131, the corner roof panels 132, and the flooring panels 106 if comprised in the system 100, may all be varied to a number that accommodates a size and a shape of that aspect of the system 100. Such aspects of the system 100 may comprise three bedrooms, four bedrooms, or more bedrooms in any number desired, a cooking and dining and living room area, or separated rooms for those purposes, a plurality of den rooms, a plurality of study rooms or office rooms, and a plurality of bathroom areas. It will be apparent to one of skill in the art that a similarly sized and shaped aspect of the system 100 may be configured with more rooms or fewer rooms, by varying the size and arrangement of the interior wall panels 122 to form a plurality of rooms of desired shapes, either by the people assembling the system 100 or by the people manufacturing the system 100.

In the various aspects of the system 100 described herein, each of the exterior walls 121, the floor and flooring panels 106, the interior wall panels 122, and the roof 130 may comprise any number of the particular panels that comprise the foregoing elements of the system 100, and wherein the phrasing elements of the system 100, and/or the phrasing a plurality of elements of the system 100, refer to any or all of the components described herein. It has been found advantageous to have any or all of the foregoing comprise a number of panels such that a size and a weight of the panels employed are moveable by people without using of heavy construction equipment, that is, in some aspects, the panels are not too large for people to move and assemble without using heavy construction equipment; while in some other aspects, the panels may require light construction equipment or heavy construction equipment. Similarly, it has been found advantageous to have any or all of the foregoing comprise a number of panels such that the panels are not so small that they create a need for additional labor to assemble the panels and link the panels to create the elements of the system 100, and create physical seams or gaps between the panels, any of which impose costs and difficulty upon the people constructing and assembling the system 100.

With reference to FIG. 1, FIG. 2, FIG. 5, and FIG. 7, one or more of the principal roof panels 131 and/or one or more of the corner roof panels 132 may comprise a plurality of support areas 140, disposed on the principal roof panels 131 or the corner roof panels 132 for bearing a load of, and attachment of, a plurality of solar panels 142, a plurality of wind-power generators 144, and/or a plurality of passive solar water heaters 146. The solar panels 142 and or the wind-power generators 144 may store power in a plurality of batteries 145, which may in one aspect of the system 100 be located within, on, or under the flooring panels 106; in other aspects of the system 100 the plurality of batteries 145 may be located within or on any of the plurality of exterior walls 121 and/or interior wall panels 122 and/or the roof 130.

With reference to FIG. 1, FIG. 2, FIG. 4, FIG. 5, and FIG. 7, in some aspects of the present disclosure, one or more of the plurality of principal roof panels 131 and/or of the plurality of corner roof panels 132 may further comprise a longitudinal opening 150 for collection of rainwater or other precipitation, advantageously disposed in or on the top surface of the plurality of principal roof panels 131 and/or of the plurality of corner roof panels 132, and situated towards the distal extent of the respective panel, that is, the downslope end, away from the center of the roof 130, which center of the roof 130 is higher than the perimeter of the roof 130. The longitudinal opening 150 may comprise a filter screen 152 for covering the longitudinal opening 150. Each longitudinal opening 150 leads to one or more of a plurality of precipitation collection drains 154, either directly or through a plurality of longitudinal conduits 156, which longitudinal conduits 156 are located in or under the principal roof panels 131 or the corner roof panels 132 for channeling precipitation to one or more of the plurality of precipitation collection drains 154. In function, the plurality of longitudinal conduits 156 are like gutters, but in certain aspects of the system 100, the longitudinal conduits 156 may be integral to the plurality of principal roof panels 131 and/or of the plurality of corner roof panels 132 in or on which the longitudinal conduits 156 are located.

With reference to FIG. 1, FIG. 2, FIG. 4, FIG. 5, FIG. 6, FIG. 7, FIG. 8, and FIG. 9, in some aspects of the present disclosure, each of the plurality of precipitation collection drains 154 leads to a first precipitation storage container 158, for which the precipitation is treated in some manner for drinking; in some aspects of the present disclosure, some of the plurality of precipitation collection drains 154 lead to a second precipitation storage container 159, for which the precipitation is not treated, such that the water in the second precipitation storage container 159 may be used for flushing a toilet 160. The precipitation so collected may be used for drinking water and/or for flushing a toilet 160, where the system 100 comprises a toilet 160. The plurality of passive solar water heaters 146 drain to a hot water tank 148. The toilet 160 may be a composting toilet model, which may flush to a toilet recycling bed 162. The toilet 160 may comprise a toilet vent 164 to ventilate and equalize air pressure to the outside of the system 100. The system 100 may further comprise a pre-fabricated plumbing wall 170, which may comprise plumbing for a shower, a toilet, a sink, or more, and may be shipped as one unit or as a plurality of plumbing wall units 172; wherein either the pre-fabricated plumbing wall 170 or the plumbing wall units 172 comprise one or more GFRC panels, plumbing pipes, plumbing connectors, and plumbing hardware.

Certain aspects of the present invention were described above. From the foregoing it will be seen that this invention is one well adapted to attain all the ends and objects set forth above, together with other advantages, which are obvious in and inherent to the inventive system disclosed herein. It will be understood that certain features and sub-combinations are of utility and may be employed without reference to other features and sub-combinations. It is expressly noted that the present invention is not limited to those aspects described above, but rather the intention is that additions and modifications to what was expressly described herein are also included within the scope of the invention. Moreover, it is to be understood that the features of the various aspects described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

Accordingly, what is claimed is:

1. A system for self-sustaining modular housing, the system comprising:

a plurality of exterior wall panels 110, a plurality of window openings 112, a plurality of exterior door openings 114, a plurality of exterior doors 116, and a plurality of windows 118; and wherein the system further comprises a roof 130, the roof 130 comprising a plurality of principal roof panels 131, a plurality of corner roof panels 132, a roof vent support 134, and a roof vent cap 136; and wherein one or more of the plurality of principal roof panels 131 and/or of the plurality of corner roof panels 132 further comprise a longitudinal opening 150, and wherein the longitudinal opening 150 comprise a filter screen 152 for covering the longitudinal opening 150, and wherein each longitudinal opening 150 leads to one or more of a plurality of precipitation collection drains 154, either directly or through a plurality of longitudinal conduits 156, which longitudinal conduits 156 are located in or under the plurality of principal roof panels 131 or the plurality of corner roof panels 132.

2. The system of claim 1, wherein each of the plurality of precipitation collection drains 154 leads to a first precipitation storage container 158.

3. The system of claim 2, wherein some of the plurality of precipitation collection drains 154 lead to a second precipitation storage container 159.

4. A system for self-sustaining modular housing, the system comprising:

a plurality of exterior walls 121, wherein the plurality of exterior walls 121 comprise: a plurality of exterior wall panels 110, and a plurality of exterior door openings 114; and a roof 130, wherein the roof 130 comprises a plurality of principal roof panels 131, a roof vent support 134, and a roof vent cap 136; and wherein one or more of the plurality of principal roof panels 131 further comprise a longitudinal opening 150, and wherein each longitudinal opening 150 leads to one or more of a plurality of precipitation collection drains 154; and a plurality of flooring panels 106; and wherein the roof 130, the plurality of exterior walls 121, and the plurality of flooring panels 106 comprise an exterior structure 139;

and wherein one or more of the flooring panels 106, the exterior wall panels 110, the exterior doors 116, the principal roof panels 131, the roof vent support 134, and/or the roof vent cap 136, comprise one or more glass fiber reinforced concrete panels, in whole or in part.

5. The system of claim 4, wherein each of the plurality of precipitation collection drains 154 leads to a first precipitation storage container 158, and wherein the system further comprises a toilet 160, a toilet vent 164, and a pre-fabricated plumbing wall 170.

* * * * *